United States Patent [19]

Hans et al.

[11] Patent Number: 5,004,186

[45] Date of Patent: Apr. 2, 1991

[54] FINLOCK ALIGNMENT MECHANISM FOR ROCKETS

[75] Inventors: Paul C. Hans, Scottsdale, Ariz.; Gary C. Rosenfield, Las Vegas, Nev.

[73] Assignee: Aerotech, Inc., Las Vegas, Nev.

[21] Appl. No.: 531,938

[22] Filed: Jun. 1, 1990

[51] Int. Cl.[5] ..... F42B 10/06

[52] U.S. Cl. ..... 244/3.25; 244/33

[58] Field of Search ..... 244/3.24, 3.25, 3.3

[56] References Cited

U.S. PATENT DOCUMENTS

| | | | |
|---|---|---|---|
| 2,691,495 | 10/1954 | Chiroky | 244/3.3 |
| 2,842,058 | 7/1958 | Küller et al. | 244/3.25 |
| 2,851,950 | 9/1958 | Van Aken et al. | 244/3.25 |
| 3,032,857 | 5/1962 | Lyon | 244/3.24 |
| 3,117,520 | 1/1964 | Kerr et al. | 244/3.24 |
| 3,158,100 | 11/1964 | Finley | 244/3.24 |
| 3,687,398 | 8/1972 | Beuschel | 244/3.24 |

*Primary Examiner*—Charles T. Jordan
*Assistant Examiner*—Richard W. Wendtland
*Attorney, Agent, or Firm*—Richard R. Mybeck

[57] ABSTRACT

A finlock mechanism for recreational rockets having a pair of finlock ring members disposed in spaced relationship to each other in circumscription about the motor tube in the rocket, each ring member having a plurality of finlock receptors disposed on the perimeter thereof in equispaced relationship to each other for receiving a finlock root extending through the rocket housing in snaplock engagement therewithin.

14 Claims, 1 Drawing Sheet

FINLOCK ALIGNMENT MECHANISM FOR ROCKETS

INTRODUCTION

This invention relates to finlock alignment mechanism for rockets and more particularly to means for firmly mounting and accurately aligning stabilizing fins for rocket assemblies to accurately align the propulsion system within the rocket body and insure that the aerodynamic stress forces created by rocket travel and motor thrust are contained by the mounting systems and aberrant flight is avoided.

BACKGROUND OF THE INVENTION

The firing of prototype experimental rockets requires that the rocket is capable of true flight so that aerodynamic studies are not flawed by structural artifacts created by guiding fin misalignment or rocket body distortion. In the case of recreational rockets, it is of paramount importance that the rocket remain on a true course to insure safety and the desired display effect. The use of bolts, screws, or welding techniques to anchor guiding fins to insure fin rigidity greatly increases the cost of manufacture and may be unsuitable for rocket component assembly by the end user. The use of cement to hold the fins to the rocket body may not provide sufficient strength and adequate fin alignment.

Prior art efforts to employ a receptacle having a plurality of slots defined therein to effect the proximal position of fin members are shown in Van Aken et al (U.S. Pat. No. 2,851,950), Lyon (U.S. Pat. No. 3,032,857), and Kerr et al (U.S. Pat. No. 3,117,520). Van Aken et al (U.S. Pat. No. 2,851,950) teaches a rocket fin assembly comprising a rocket casing having a plurality of axially extending slots formed therein and opening through one end of the casing, each being adapted to receive a fin from the fin assembly therein to be secured thereby. The fin assembly further comprises a central core having a pair of obially spaced rings to which the several fins are secured to form an integral unit therewith. The rings have an outer diameter substantially equal to the inner diameter casing.

Lyon (U.S. Pat. No. 3,032,857) teaches apparatus for forming integral ribs upon the circumference of a rigid tubular shape. Each rib member comprises a pair of upwardly and radially inwardly extending rib elements of a predetermined length and thickness. Between each of the rib elements, there is received a shaped base portion of each of the fins. The base portion has, along its length, a pair of outwardly extending wings or arms received in notches in each of the rib elements to restrain movement of the fins.

Kerr et al (U.S. Pat. No. 3,117,520) also teaches an arrangement for attaching a fin to the surface of a missile in which the fin is seated in a channel defined on the outer surface of the missile and transversely extending pin members lock the fin member in its desired position.

While each of the prior art devices achieved to a degree its desired goal, none were able to attain complete interlocking stress paths for the aerodynamic and motor thrust forces especially needed for safe and effective operation of hobby-class rockets in neighborhood surroundings.

Accordingly, a need exists for rocket assembly components which are user friendly, which can be constructed from light and essentially non-metallic parts and which, when assembled, will result in a rocket capable of true flight.

BRIEF SUMMARY OF THE INVENTION

The present invention relates to means and methods for the simplified manufacture of rockets having the capability of true flight comprising centering rings which are secured to ring clips which in turn are attached to the internal motor tube body contained within the external rocket body. The fin design employed herein permits each fin to be readily snapped into the ring clips at a ninety degree angle to the rocket body to create a rigid rocket structure capable of withstanding the shear forces created during and after the rocket burn. The means and methods hereof enable rocket modules to be assembled by persons having minimal skills in rocket construction.

Accordingly, a prime object of the present invention is to provide a new and improved finlock alignment mechanism for rockets.

Another object of the present invention is to provide improved means and methods to assemble a rocket which requires only minimal skills and yet provides an aerodynamically correct rocket capable of true flight.

A still further object of the present invention is to provide an improved finlock alignment mechanism for recreational rockets which facilitates the integrity of the rocket during flight and recovery.

Still another object of the present invention is to provide user-friendly means and methods for creating and assembling launchable rockets which are authentic in appearance and safe in use.

These and still further objects as shall hereinafter appear are fulfilled by the present invention in a remarkably unexpected fashion as will readily appear from the following detailed description of exemplary embodiments especially when read in conjunction with the accompanying drawing in which like parts bear like numerals throughout the several views.

DESCRIPTION OF PREFERRED EMBODIMENTS

The present invention relates to rockets and more particularly to means and methods for firmly mounting and accurately aligning stabilizing fins in a rocket assembly to insure that the stress forces created by rocket travel and motor thrust are contained by the mounting systems and aberrant flight is avoided.

Figure 1:
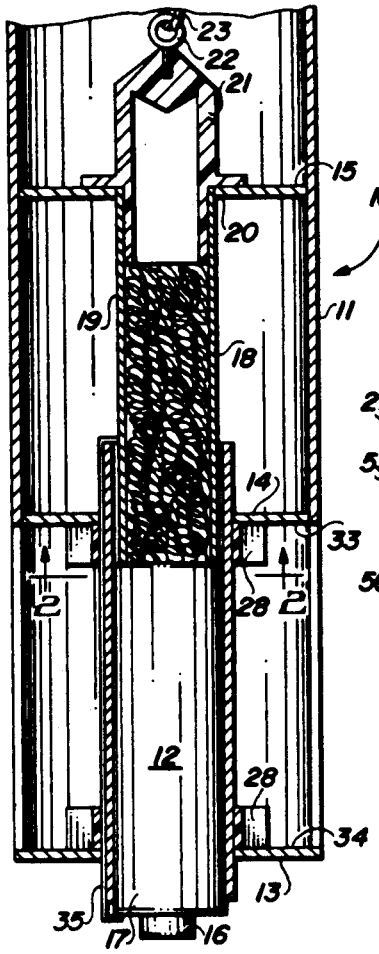
FIG. 1 is a cross sectional view of a rocket structure embodying the present invention sans nosecone.
Figure 4:
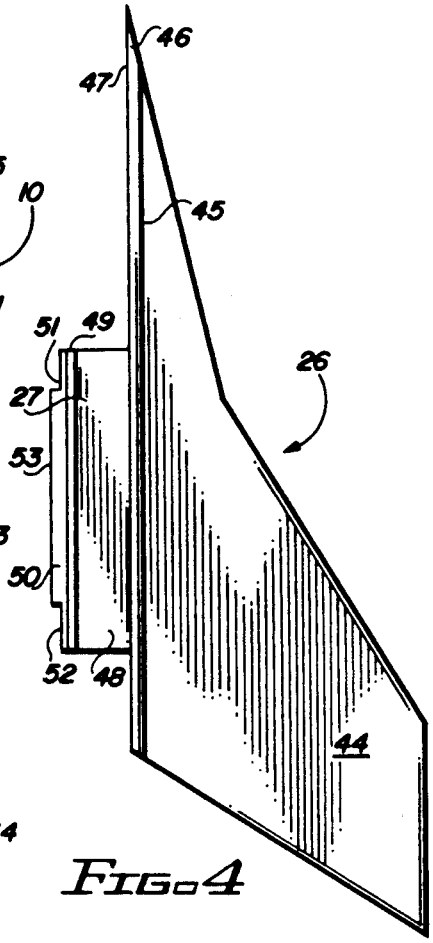
FIG. 4 is a plan view of the fin and fin attachment extension.

A suitable rocket, with its nose cone removed for clarity, is shown in FIG. 1 and identified by the general reference numeral 10. In general, rocket 10 comprises a tubular body portion 11 having a motor tube 12 mounted therewithin and secured in concentric relationship thereto by a plurality of annular centering means 13, 14, 15 disposed in spaced generally parallel relationship to each other. A suitable rocket motor 16 is telescopically inserted in through the lower end 17 of motor tube 12 and secured thereto for use in the conventional fashion. Suitable means 18 for dissipating heat from the combustion gases generated by firing rocket motor 16 is disposed in the upper portion 19 of motor tube 12 which in turn is capped at the upper end 20 thereof by a ventilation means 21 which may include a suitable anchor 22 for securing the tether 23 of an accompanying parachute (not shown).

In normal practice, body portion 11 is made of fiberboard or like strong light-weight material to form a tube of various lengths and diameters depending on the size of the rocket desired.

The present invention relates particularly to a fin and ring assembly for use with rockets which, as will appear below, enables a rocket fin 26 to be readily aligned and secured by the coaction of the fin root 27 thereof with a plurality of finlock ring members 28.

Figure 2:
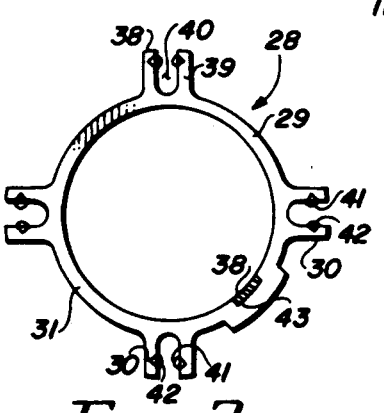
FIG. 2 is a cross-section taken on line 2—2 of FIG. 1.
Figure 3:
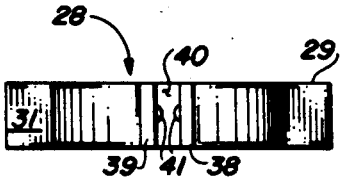
FIG. 3 is a side view of the locking ring shown in FIG. 2.
Figure 5:
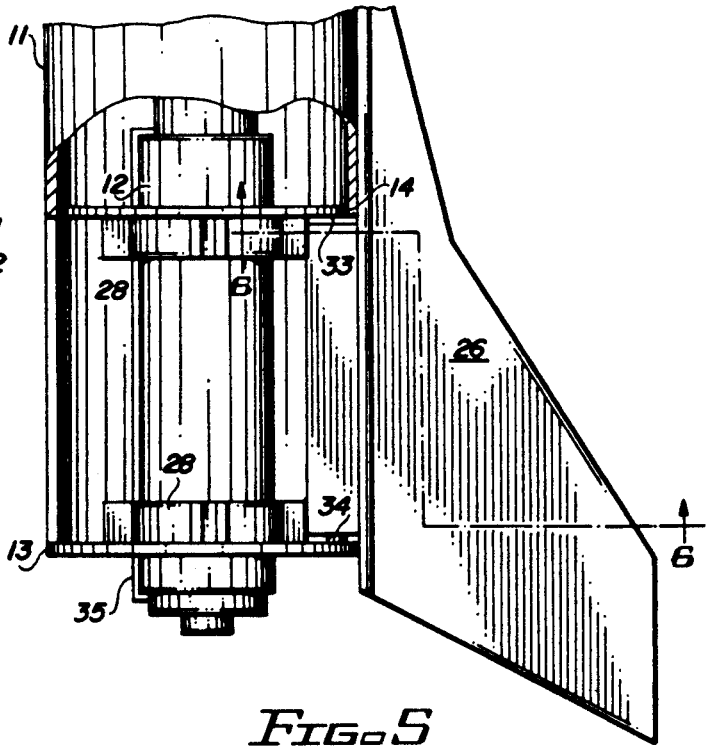
FIG. 5 is a cross sectional view showing the fin and ring attachments.

As shown in FIGS. 2 and 3, a finlock ring member 28 comprises an annular body portion 29 having a plurality of fin-root receptors 30 defined on the outer perimeter 31 of body portion 29 in equi-space relationship to each other. In a conventional four-finned rocket, four receptors 30 will be provided, each being spaced 90° from each adjacent receptor 30. In a three-finned rocket, three receptors 30 will be provided, each being spaced 120° from each adjacent receptor 30. In the present discussion, a four-finned rocket will be used o exemplify the present invention it being understood that the principals hereof are equally applicable to other fin arrangements.

In one practice of the present invention as shown in FIG. 1, motor tube 12 is mounted in true concentric relationship to and within body portion 11 by the action of centering rings 13, 14 and 15 thereupon. Finlock ring members 28 are disposed between rings 13, and 14 and are suitably secured, as by glue or cement, to the motor tube 12. Metallic motor hook 35 extends axially along motor tube 12 and is secured by centering rings 13, 14, and finlock rings 28 by passing through slots 43 defined therein. Motor hook 35 keeps motor 16 in its desired position relative to motor tube 12 during the burn of the propellent and ejection charges.

Figure 6:
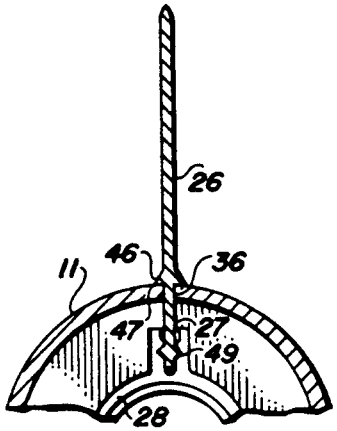
FIG. 6 is an enlarged detail of the snap in fin attachment.

Fin 26 is readily and easily attached to tubular rocket body portion 11 by inserting fin root 27 through an axially extending slot 36 defined in body portion 11, as shown in FIG. 6, for locking engagement in the finlock ring receptor 30 corresponding thereto as will now be described in detail. A number of slots 36 equal to the number of fins 26 required for a given rocket are cut through body portion 11 in exact alignment with receptors 30.

Referring again to FIGS. 2 and 3, each receptor 30 is integrally formed with body portion 29 and extends radially outward from the outer perimeter 31 of ring member 28. Each receptor 30 comprises a first arm member 38 and a second arm member 39 coacting with each other to define fin root receiving channel 40 therebetween. Each arm member, for example, arm member 38 has a transverse slot 41 formed therein in registry with a like slot 42 formed in arm member 39. Slots 41, 42 coact to receive fin root 27 in snap fit engagement when root 27 is inserted into channel 40 in accordance with the present discussion.

Each fin 26 comprises an aerodynamically shaped polyhedral body portion 44 terminating in an elongated vertical edge 45 having a triangular base portion 46 formed therewith and extending axially therealong. Base portion 46 has a planar surface 47 on the bottom thereof which surface 47 substantially conforms to the exterior contour of body portion 11.

Fin 26 further comprises a fin root 27 extending perpendicularly from surface 47 and has a generally rectangular body portion 48 having a ridge portion 49 disposed longitudinally thereacross on both sides thereof. As will hereafter appear, ridge portions 49 respectively coact with and engage slots 41, 42 in receptor 30 to provide a snap-lock fit when fin root 27 is properly inserted into channel 40.

Generally rectangular extension portion 50 abuts ridge portions 49 and extends outwardly therefrom. Portion 50 has a first seat 51 and a second seat 52 defined therein to define a tab of key 53 therebetween. Each seat 51, 52 corresponds to the, receptor 30 disposed in registered relationship thereto while key 53, formed therebetween, engages the outer surface of motor tube 12 intermediate the receptors 30 and in axial abutment therewith. Similar connections are made at each of the remaining receptor sites until the desired number of fins have been installed.

To assemble a rocket fin 26 to rocket 10, as shown in FIG. 6, fin root 27 is passed through slot 36 until seats 51, 52 enter into and are secured by corresponding receptor 30 whereupon ridges 49 are by the action of ridges 49 enterring slots 41, 42 where they are locked.

While the exemplary embodiment shown herein employs two finlock ring members 28, it is further contemplated that in certain sized rockets having proportionately different sized fins, a single ring member or a plurality of ring members operating in the manner hereof will properly mount and align the fin. The assembled rocket is thus ready to be mounted in a rocket launcher for ignition, flight, parachute deployment and spent rocket recovery.

From the foregoing, it becomes apparent that new and useful finlock alignment mechanism for rockets has been herein described and illustrated which fulfill all of the aforestated objectives in a remarkably unexpected fashion. It is of course understood that such modifications, alterations and adaptations as may readily occur to an artisan having the ordinary skills to which this invention pertains are intended within the spirit of the present invention which is limited only by the scope of the claims appended hereto.

Accordingly what is claimed is:

1. For use in a recreational rocket having a body portion and a motor tube mounted therewith, a finlock mechanism comprising a finlock ring member disposed in circumscription about the motor tube within the body portion, a plurality of rocket fins, each said fin having a body portion and a root portion, said root portion being extendible through said rocket body portion for snap-lock engagement within said ring member to hold said fin body portion in truly aligned and secure surface-to-surface engagement with said rocket body portion.

2. A finlock mechanism according to claim 1 having a plurality of finlock ring members disposed in spaced generally parallel relationship to each other.

3. A finlock mechanism according to claim 1 in which each of said finlock ring members comprises a plurality of fin root receptors disposed in equispaced relationship on the perimeter of said ring member.

4. A finlock mechanism according to claim 3 in which each of said receptors comprises a first arm portion and a second arm portion disposed in exact parallel relationship to each other and coacting to define a fin root receiving channel therebetween.

5. A finlock mechanism according to claim 4 in which said fin root has a ridge defined thereon for locking coaction with said receptors when said fin root is inserted into said channel.

6. A finlock mechanism according to claim 5 in which each of said arm portions has a slot defined therein and coactive to receive and secure said ridge on said fin root therewithin.

7. A finlock mechanism according to claim 1 in which said fin root comprises a body portion, an extension portion integrally formed with said body portion and extending therefrom, said extension portion having a first and second end portion removed therefrom to define first and second seat having a key therebetween, said key being adapted for interposition between said ring members when said first and second seats of said fin root are seated in the corresponding one said fin root receptors.

8. A finlock mechanism according to claim 3 in which said fin root comprises a body portion, an extension portion integrally formed with said body portion and extending therefrom, said extension portion having a first and second end portion removed therefrom to define first and second seat having a key therebetween, said key being adapted for interposition between said ring members when said first and second seats of said fin root are seated in the corresponding one said fin root receptors.

9. A finlock mechanism according to claim 7 in which each of said receptors comprises a first arm portion and a second arm portion disposed in exact parallel relationship to each other and coact to define a fin root receiving channel therebetween.

10. A finlock mechanism according to claim 8 in which each of said receptors comprises a first arm portion and a second arm portion disposed in exact parallel relationship to each other and coact to define a fin root receiving channel therebetween.

11. A finlock mechanism according to claim 9 in which each of said arm portions has a slot defined therein and coactive to engage and secure said fin root inserted therewithin.

12. A finlock mechanism according to claim 10 in which each of said arm portions has a slot defined therein and coactive to engage and secure said fin root inserted therewithin.

13. A finlock mechanism according to claim 11 in which said fin root has a ridge defined thereon for locking coaction with said slots when said fin root is inserted into said channel.

14. A finlock mechanism according to claim 12 in which said fin root has a ridge defined thereon for locking coaction with said slots when said fin root is inserted into said channel.

* * * * *